US012030608B2

(12) United States Patent
Kirchhoff et al.

(10) Patent No.: US 12,030,608 B2
(45) Date of Patent: Jul. 9, 2024

(54) ELECTRIC MARINE PROPULSION SYSTEMS AND METHODS OF CONTROL

(71) Applicant: Brunswick Corporation, Mettawa, IL (US)

(72) Inventors: Thomas S. Kirchhoff, Waupaca, WI (US); Jason S. Arbuckle, Horicon, WI (US)

(73) Assignee: Brunswick Corporation, Mettawa, IL (US)

( * ) Notice: Subject to any disclaimer, the term of this patent is extended or adjusted under 35 U.S.C. 154(b) by 623 days.

(21) Appl. No.: 17/131,115

(22) Filed: Dec. 22, 2020

(65) Prior Publication Data

US 2022/0194542 A1 Jun. 23, 2022

(51) Int. Cl.
*B63H 21/21* (2006.01)
*B63H 21/17* (2006.01)

(52) U.S. Cl.
CPC ..... *B63H 21/21* (2013.01); *B63H 21/17* (2013.01); *B63H 2021/216* (2013.01)

(58) Field of Classification Search
CPC .... B63B 21/21; B63H 21/17; B63H 2021/216
See application file for complete search history.

(56) References Cited

U.S. PATENT DOCUMENTS 6,507,164 B1 1/2003 Healey et al.
6,902,446 B1 6/2005 Healey
7,150,662 B1 12/2006 Janitz
7,385,365 B2 6/2008 Feick
7,812,467 B1 * 10/2010 Lemancik ..... H02P 9/14 290/40 C
7,893,641 B2 * 2/2011 Norell ..... H02H 7/093 318/434
7,931,513 B2 * 4/2011 Suzuki ..... B63H 21/21 440/86
8,020,650 B2 * 9/2011 Van Maanen ..... B60L 3/0046 180/65.265

(Continued)

FOREIGN PATENT DOCUMENTS

AU 2005300079 B2 5/2006
CA 2643878 5/2010

(Continued)

OTHER PUBLICATIONS

Extended European Search Report for Corresponding European Patent Application No. 21215496.7, dated May 27, 2022.

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

A method of controlling an electric marine propulsion system configured to propel a marine vessel including measuring at least one parameter of an electric motor in the electric marine propulsion system and determining that the parameter measurement indicates an abnormality in the electric marine propulsion system. A reduced operation limit is then determined based on the at least one parameter measurement, wherein the reduced operation limit includes at least one of a torque limit, an RPM limit, a current limit, and a power limit. The electric motor is then controlled such that the reduced operation limit is not exceeded.

22 Claims, 5 Drawing Sheets

(56) References Cited

U.S. PATENT DOCUMENTS

| | | | | |
|---|---|---|---|---|
| 9,533,747 | B2 * | 1/2017 | Arbuckle | B63H 21/20 |
| 10,155,578 | B1 * | 12/2018 | Osthelder | G05D 1/0016 |
| 10,647,398 | B2 * | 5/2020 | Biebach | B63H 21/21 |
| 10,654,551 | B1 * | 5/2020 | Doremus | B63B 1/246 |
| 10,723,430 | B2 * | 7/2020 | Raimondi | B63H 1/18 |
| 2010/0144219 | A1 | 6/2010 | Balogh et al. | |
| 2010/0248560 | A1 * | 9/2010 | Ito | B63H 21/22 440/1 |
| 2013/0103333 | A1 * | 4/2013 | Nishida | G01R 31/3842 702/63 |
| 2015/0015168 | A1 * | 1/2015 | Terao | H02P 29/032 318/139 |
| 2017/0066531 | A1 * | 3/2017 | McAdoo | B64C 39/024 |
| 2017/0227590 | A1 * | 8/2017 | Said | H02P 29/0241 |
| 2018/0298754 | A1 * | 10/2018 | Kodaira | B63B 22/24 |
| 2020/0290742 | A1 * | 9/2020 | Kumar | B64D 27/24 |
| 2021/0270238 | A1 * | 9/2021 | Haas | F03D 9/25 |
| 2022/0289355 | A1 * | 9/2022 | Kiyooka | F03B 13/26 |
| 2023/0058169 | A1 * | 2/2023 | Cella | G06N 7/01 |

FOREIGN PATENT DOCUMENTS

| | | | | |
|---|---|---|---|---|
| CA | 2643878 | A1 * | 5/2010 | B63H 21/17 |
| CN | 105083513 | | 11/2015 | |
| CN | 111301655 | | 6/2020 | |
| WO | 2020099412 | A1 | 5/2020 | |

* cited by examiner

| MOTOR TEMPERATURE [degC] | 0 | 5 | 10 | 60 | 110 | 120 | 130 |
|---|---|---|---|---|---|---|---|
| POWER LIMIT% | 50 | 75 | 100 | 100 | 100 | 60 | 10 |

FIG. 5A

| MOTOR CURRENT [amp] | 33 | 35 | 37 | 38 | 39 | 40 | 41 |
|---|---|---|---|---|---|---|---|
| POWER LIMIT% | 100 | 100 | 100 | 90 | 70 | 10 | 10 |

FIG. 5B

| BATTERY TEMPERATURE [degC] | 70 | 80 | 90 | 95 | 100 | 105 | 110 |
|---|---|---|---|---|---|---|---|
| POWER LIMIT% | 100 | 100 | 100 | 90 | 75 | 40 | 10 |

FIG. 5C

| MOTOR INPUT VOLTAGE [volt] | 31 | 41 | 46 | 48 | 52 | 54 | 56 |
|---|---|---|---|---|---|---|---|
| POWER LIMIT% | 10 | 75 | 100 | 100 | 100 | 95 | 10 |

FIG. 5D

| MOTOR SPEED [RPM] | 20 | 80 | 100 | 3000 | 3050 | 3100 | 3200 |
|---|---|---|---|---|---|---|---|
| POWER LIMIT% | 10 | 85 | 100 | 100 | 90 | 75 | 10 |

FIG. 5E

| VIBRATION [g] | 0.25 | 0.30 | 0.35 | 0.525 | 0.70 | 0.875 | 1.05 |
|---|---|---|---|---|---|---|---|
| RPM LIMIT% | 100 | 100 | 100 | 90 | 80 | 30 | 10 |

FIG. 5F

ELECTRIC MARINE PROPULSION SYSTEMS AND METHODS OF CONTROL

FIELD

The present disclosure generally relates to marine propulsions systems, and more particularly to electric marine propulsion systems having electric motors and methods for controlling the same.

BACKGROUND

Electric propulsion systems comprising an electric motor rotating a propeller are known. For example, on-board electric drive systems and outboard electric drive systems have been developed for propelling marine vessels. Different power supply arrangements for powering electric propulsion systems are also known. Such power storage systems include one or more batteries or banks of batteries, and or may include other storage devices such as one or more ultracapacitors, fuel cells, flow batteries, and or other devices capable of storing and outputting electric energy.

The following U.S. Patents provide background information and are incorporated herein by reference, in entirety.

U.S. Pat. No. 6,507,164 discloses a trolling motor having current based power management including: an electric motor; a motor controller having an output for providing voltage to the motor; and a current sensor for measuring the electrical current flowing through the motor. Upon determining that the trolling motor has been operating above its continuous duty limit for a predetermined period of time, the motor controller begins reducing the voltage output to the motor until reaching an acceptable output voltage. In another embodiment, the controller is operated in three distinct modes with three distinct sets of operating parameters, namely: a normal mode wherein the output is set to a commanded level; a current limit mode wherein the output is set to a safe, predetermined level; and a transitional mode wherein the output is incrementally changed from the predetermined level to the commanded level.

U.S. Pat. No. 6,902,446 discloses a DC motor having a motor housing and a motor controller housed within the motor housing. In a preferred embodiment the heat producing components of the motor controller are in thermal communication with the housing such that the majority of the heat produced by such components will be readily conducted to the environment in which the motor is operating. When incorporated into a trolling motor, the motor housing of the present invention will be submerged so that controller produced heat will be dissipated into the water in which the trolling motor is operated.

U.S. Pat. No. 7,385,365 discloses a method for error detection of a brushless electric motor, where at least one first motor parameter is measured or determined, and a second, estimated motor parameter is estimated on the basis of the first motor parameter. The second, estimated motor parameter is compared to a second, measured or determined motor parameter. An error of the electric motor can be found out according to the comparison.

U.S. Pat. No. 10,723,430 discloses a propeller propulsion system for a watercraft that includes at least one electric motor and a propeller which can be driven by the electric motor. The propeller is a surface piercing propeller. The propulsion system includes a box-like body having a side wall on which the electric motor is fixed and a cover part on which an outdrive of the surface piercing propeller is applied. The side wall and the cover part include holes through which a shaft of the motor and a shaft of the outdrive respectively pass. The box-like body includes means for transmission of motion from the drive shaft to the outdrive shaft, and the propulsion system includes means for fixing the box-like body to a transom of the watercraft.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a method of controlling an electric marine propulsion system configured to propel a marine vessel includes measuring at least one parameter of an electric motor in the electric marine propulsion system and determining that the parameter measurement indicates an abnormality in the electric marine propulsion system. A reduced operation limit is then determined based on the at least one parameter measurement, wherein the reduced operation limit includes at least one of a torque limit, an RPM limit, a current limit, and a power limit. The electric motor is then controlled such that the reduced operation limit is not exceeded.

In one embodiment, determining that the parameter measurement indicates an abnormality in the electric marine propulsion system includes determining that the parameter measurement is outside of a threshold range.

In one embodiment, determining the reduced operation limit includes utilizing a lookup table providing reduced operation limits corresponding to various parameter values within a range of potential values for the at least one parameter. In one exemplary embodiment, the lookup table provides reduced operation limits indexed based on various parameter values for each of at least two parameters, and the reduced operation limit is calculated based on at least two parameter measurements utilizing the two-dimensional lookup table.

In one embodiment, an electric marine propulsion system includes an electric motor driving a propeller into rotation and configured to propel a marine vessel. A power storage device is configured to power the electric motor and one or more sensors are configured to measure a parameter of the electric marine propulsion system, including at least one of a motor temperature sensor configured to sense a temperature of the electric motor, a battery temperature sensor configured to sense a temperature within the power storage device, a current sensor configured to sense an input current supply to the electric motor, a voltage sensor configured to sense an input voltage supply to the electric motor, a motor speed sensor configured to sense a rotational speed of the electric motor, and a propeller speed sensor configured to sense a rotational speed of the propeller. A control system is configured to determine that the at least one measured parameter of the electric marine propulsion system is outside of a threshold range indicating an abnormality. A reduced operation limit is then determined based on the at least one parameter, wherein the reduced operation limit includes at least one of a torque limit, an RPM limit, a current limit, and a power limit. The electric motor is then controlled such that the reduced operation limit is not exceeded.

Various other features, objects, and advantages of the invention will be made apparent from the following description taken together with the drawings.

BRIEF DESCRIPTION OF THE DRAWINGS

The present disclosure is described with reference to the following Figures.

FIG. 4B depicts a control implementation utilizing a reduced operation limit according to the present disclosure.

FIGS. 5A-5F depict exemplary tables providing reduced operation limits corresponding to various parameter values.

DETAILED DESCRIPTION

Figure 1:
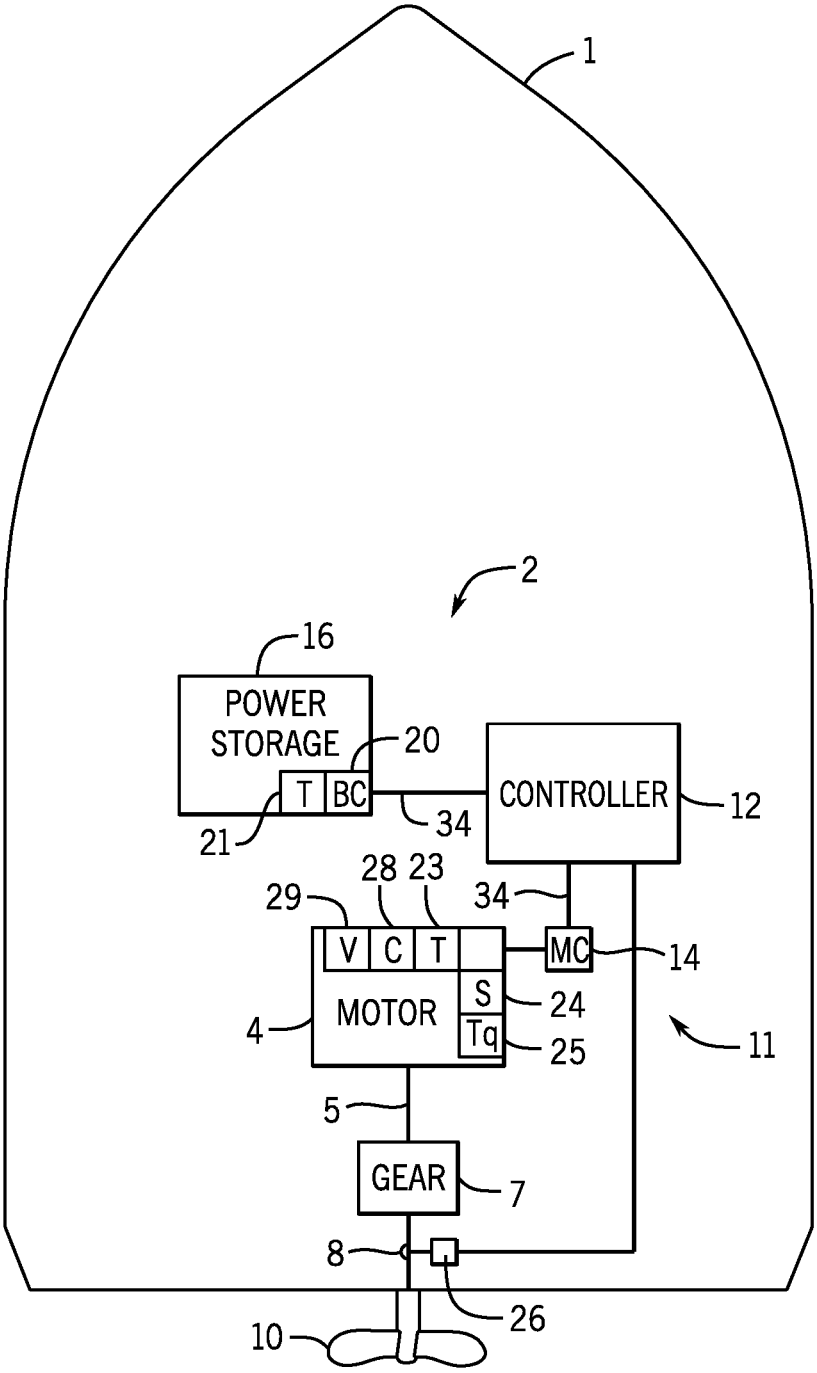
FIG. 1 is a schematic depiction of a marine vessel having an exemplary electric marine propulsion system in accordance with the present disclosure.

The inventors have recognized that modern marine propulsion systems should have a protection system, or "guardian" system and protection scheme, to prevent and protect the drive unit from destruction or immediate catastrophic failure in the event of a problem. This protection is particularly important in marine propulsion systems since boaters can be miles from shore and otherwise out of typical communication ranges, and thus loss of propulsion can create a dangerous or even life threatening situation where the boater is stranded and unable to get help. Guardian systems and features developed for internal combustion marine propulsion systems are not applicable to electric propulsion systems because the monitored values, assessment logic, and control mechanisms are very different in internal combustion engines compared to electric motors.

In view of the foregoing problems and challenges, and based on their extensive experimentation and research in the relevant field, the inventors have developed the disclosed system and method for electric marine propulsion control where one or more parameters of the electric marine propulsion system are monitored and one or more reduced operation limits are determined based on the monitored parameters in order to prevent short-term catastrophic failure of the electric motor and or other aspects of the electric marine propulsion system. The system is configured to enable the operator to continue at least low speed propulsion of the marine vessel to facilitate their return to safety. Catastrophic failure is where the propulsion system no longer operates to propel the marine vessel, such as to propel a marine vessel in a direction instructed by an operator via a steering input or by an automated guidance system controlling a direction of the marine vessel. Short-term catastrophic failure is where such total failure of the propulsion system operation occurs immediately, or within minutes, or within the current operation session by the operator.

In one embodiment, the system determines a reduced operation limit calibrated to enable continued operation of the propulsion system to propel the marine vessel to shore or to a starting point of the operator's trip, or to a home destination where a marine vessel is typically stored. In another embodiment, the reduced operation limit may be calibrated to enable continued operation of the propulsion system for several miles or several hours to return an operator to safety for a majority of boating applications. In still another embodiments, the reduced operation limits may be calibrated to enable an operator to continue indefinite use of the propulsion system under the current measured conditions.

In certain embodiments, a reduced operation limit includes at least one of a torque limit, an RPM limit, a current limit, a power limit. The torque limit limits an output torque of the electric motor 4. The RPM limit limits the rotational speed of the electric motor 4, or alternatively the rotational speed of the propeller 8. The current limit limits a current supplied to the electric motor 4. A power limit limits the total power supplied to the electric motor, which may be effectuated as a current limit and/or a voltage limit. Similarly, in certain embodiments, the reduced operation limit may specifically include a voltage limit in addition to or as an alternative to a power limit or current limit.

Figure 2:
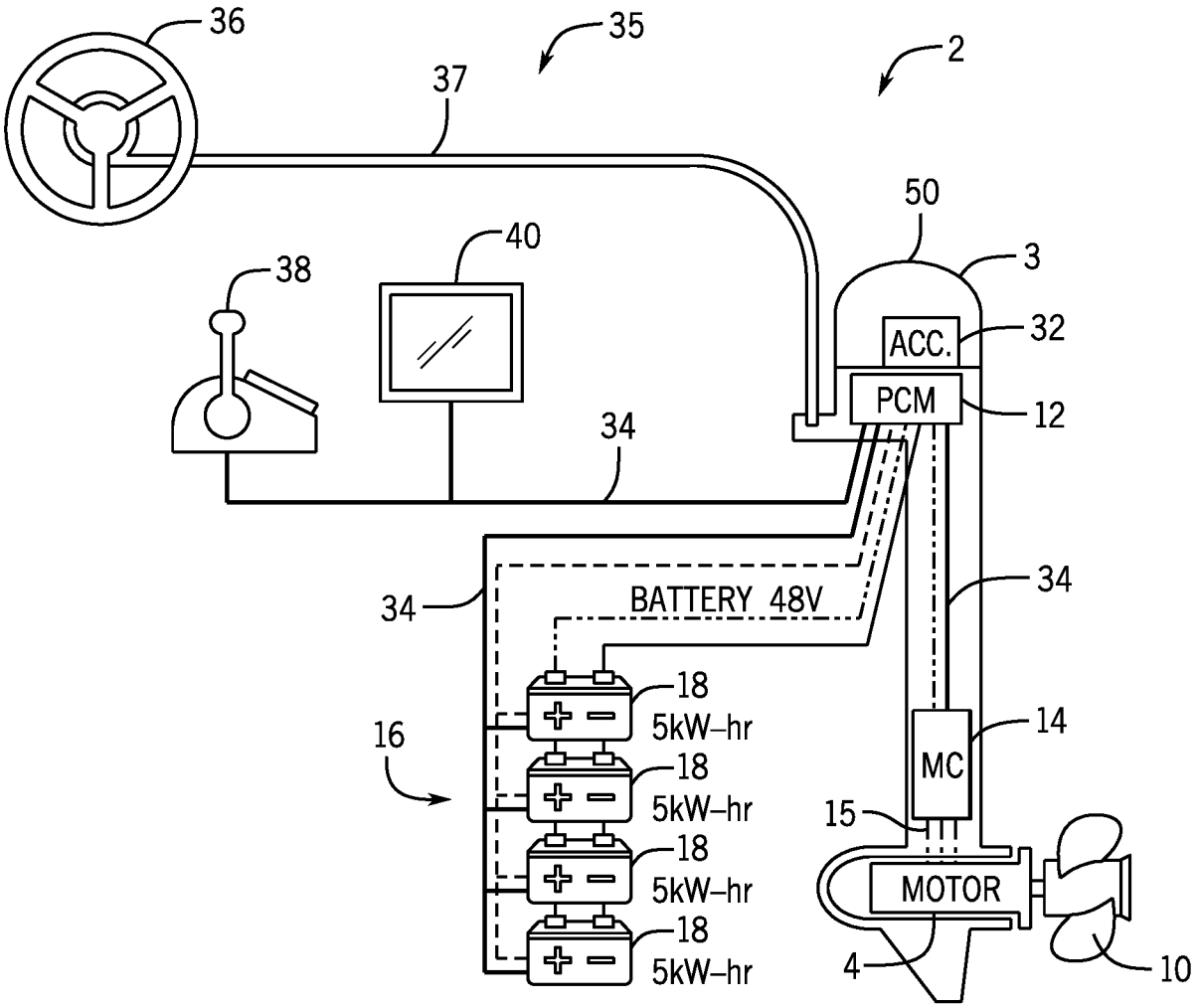
FIG. 2 is a schematic of another exemplary electric marine propulsion system in accordance with the present disclosure.

FIG. 1 depicts an exemplary embodiment of a marine vessel 1 having an electric marine propulsion system 2 configured to propel the marine vessel in a direction instructed by an operator via a steering control system, or by a guidance system configured to automatically control steering of the marine vessel to steer the vessel toward a predetermined location or global position. Referring also to FIG. 2, the electric propulsion system 2 includes an electric marine drive 3 having an electric motor 4 configured to propel the marine vessel 1 by rotating a propeller 10, as well as a power storage system 16, a control system 11, and a user interface system 35. The motor 4 may be, for example, a brushless electric motor, such as a brushless DC motor. In other embodiments, the electric motor may be a DC brushed motor, an AC brushless motor, a direct drive, a permanent magnet synchronous motor, an induction motor, or any other device that converts electric power to rotational motion. In certain embodiments, the electric motor 4 includes a rotor and a stator, as is well known in the relevant art.

The electric motor 4 is electrically connected to and powered by a power storage device 16. The power storage device 16 stores energy for powering the electric motor 4 and is rechargeable, such as by connection to shore power when the electric motor 4 is not in use. Various power storage devices and systems are known in the relevant art. The power storage device 16 may be a battery system including one or more batteries or banks of batteries. In other embodiments, the power storage device 16 may include one or more fuel cells, flow batteries, ultracapacitors, and/or other devices capable of storing and outputting electric energy. The power storage device 16 may further include a battery controller 20 configured to monitor and/or control aspects of the power storage device 16. For example, the battery controller 20 may receive inputs from one or more sensors within the power storage device 16, such as a temperature sensor 21 configured to sense a temperature within a housing of the power storage device where one or more batteries or other storage elements are located. The battery controller 20 may further be configured to receive information from current, voltage, and/or other sensors within the power storage device 16, such as to receive information about the voltage, current, and temperature of each battery cell within the power storage device 16. In addition to the temperature of the power storage device, the battery controller 20 may be configured to calculate a state of charge of the power storage device 16, a state of health of the power storage device 16, a temperature of the power storage device, etc.

The electric motor 4 is operably connected to the propeller 10 and configured to rotate the propeller 10. As will be known to the ordinary skilled person in the relevant art, the propeller 10 may include one or more propellers, impellers, or other propulsor devices and that the term "propeller" may be used to refer to all such devices. In certain embodiments, such as that represented in FIG. 1, the electric motor 4 may be connected and configured to rotate the propeller 10 through a gear system 7 or a transmission. In such an embodiment, the gear system 7 translates rotation of the motor output shaft 5 to the propeller shaft 8 to adjust conversion of the rotation and/or to disconnect the propeller shaft 8 from the drive shaft 5, as is sometimes referred to in the art as a "neutral" position where rotation of the drive shaft 5 is not translated to the propeller shaft 8. Various gear systems 7, or transmissions, are well known in the relevant art. In other embodiments, the electric motor 4 may directly connect to the propeller shaft 8 such that rotation of the drive shaft 5 is directly transmitted to the propeller shaft 8 at a constant and fixed ratio.

Each electric motor 4 may be associated with a motor controller 14 configured to control power to the electric motor, such as to the stator winding thereof. The motor controller 14 is configured to control the function and output of the electric motor 4, such as controlling the torque outputted by the motor, the rotational speed of the motor 4, as well as the input current, voltage, and power supplied to and utilized by the motor 4. In one arrangement, the motor controller 14 controls the current delivered to the stator windings via the leads 15, which input electrical energy to the electric motor to induce and control rotation of the rotor.

Sensors may be configured to sense the power, including the current and voltage, delivered to the motor 4. For example, a voltage sensor 28 may be configured to sense the input voltage to the motor 4 and a current sensor 29 may be configured to measure input current to the motor 4. Accordingly, power delivered to the motor 4 can be calculated and such value can be used for monitoring and controlling the electric propulsion system 2, including for monitoring and controlling the motor 4. In the depicted example, the current sensor 29 and voltage sensor 28 may be communicatively connected to the motor controller 14 in order to provide measurement of the voltage supplied to the motor and current supplied to the motor for thereto. The motor controller 14 is configured to provide appropriate current and or voltage to meet the demand for controlling the motor 4. For example, a demand input may be received at the motor controller 14 from the central controller 12, such as based on an operator demand at a helm input device, such as the throttle lever 38. In certain embodiments, the motor controller 14, voltage sensor 28, and current sensor 29 may be integrated into a housing of the electric motor 4, in other embodiments the motor controller 14 may be separately housed.

Various other sensors may be configured to measure and report parameters of the electric motor 4. For example, the electric motor 4 may include means for measuring and or determining the torque, rotation speed (motor speed), current, voltage, temperature, vibration, or any other parameter. In the depicted example, the electric motor 4 includes a temperature sensor 23 configured to sense a temperature of the motor 4, a speed sensor 24 configured to measure a rotational speed of the motor 4, and a torque sensor 25 for measuring the torque output of the motor 4. An accelerometer 32 may be configured to measure vibration of the motor 4 or of the electric drive 3 more generally. A propeller speed sensor 26 may be configured to measure a rotational speed of the propeller 10. For example, the propeller speed sensor 26 and/or the motor speed sensor 24 may be a Hall Effect sensor or other rotation sensor, such as using capacitive or inductive measuring techniques. In certain embodiments, one or more of the parameters, such as the speed, torque, or power, may be calculated based on other measured parameters or characteristics. For example, the torque may be calculated based on power characteristics in relation to the rotation speed of the electric motor, for example.

The various parameters of the electric propulsion system are utilized for detection of an abnormality and determining a reduced operation limit appropriate for enabling continued operation of the electric propulsion system 2 to prevent short-term catastrophic failure of the electric motor and enable the operator to continue at least low speed propulsion of the marine vessel in order to return to shore or otherwise reach safety. The parameters may include one or more of the temperature of the electric motor, the temperature within the power storage device, the current amount supplied to the electric motor, the voltage supplied to the electric motor, the rotational speed of the electric motor, the torque supplied by the electric motor, and the rotational speed of the propeller 10.

If at least one of the monitored parameters exceeds a threshold indicating an abnormality—e.g., is outside of a threshold range established for normal operation of the electric propulsion system—then a reduced operation limit is calculated. In certain embodiments, the reduced operation limit may be calculated or determined based on one parameter or based on a plurality parameters of the electric marine propulsion system. For example, when one of the plurality of parameters being monitored exceeds a respective threshold indicating an abnormality, the reduced operation limit may be determined based on two or more of the plurality of parameters even if all such parameters have not exceeded the threshold. To provide just one example, if a temperature of the electric motor exceeds a temperature threshold indicating an abnormally high temperature for the electric motor 4, in certain embodiments a reduced operation limit may be determined based on the measured temperature in combination with one or more other parameters, such as based on temperature and input current and/or temperature and torque output. Various examples of the reduced operation limit determination are provided herein.

The reduced operation limit determination may be performed by the control system 11, such as by the central controller 12. The electric propulsion system 2 may include a plurality of controllers communicatively connected and configured to cooperate to provide the method of controlling the electric marine propulsion system described herein. For example, the motor controller 14, battery controller 20, and central controller 12 and may cooperate as a distributed control system 11 to effectuate control of the marine propulsion system as described herein such that the reduced operation limit is not exceeded and catastrophic failure of the electric motor is delayed or prevented. A person of ordinary skill in the art will understand in view of the present disclosure that other control arrangements are available and that the control functions described herein may be combined into a single controller or divided into any number of a plurality of distributed controllers that are communicatively connected. In certain embodiments, various sensing devices 21, 23-25, 26, and 28-29, may be configured to communicate with a local controller, such as the motor controller 14 or battery controller 20, and in other embodiments the sensors 21, 23-25, 26, and 28-29 may communicate with the central controller 12 and one or more of the motor controller 14 and or battery controller 20 may be eliminated. Controllers 12, 14, 20 (and or the sensors) may be configured to communicate via a communication bus such as a CAN bus or a LIN bus, or by single dedicated communication links between controllers 12, 14, 20.

Each controller may comprise a processor and a storage device, or memory, configured to store software and/or data utilized for controlling and or tracking operation of the electric propulsion system 2. The memory may include volatile and/or non-volatile systems and may include removable and/or non-removable media implemented in any method or technology for storage of information. The storage media may include non-transitory and/or transitory storage media, including random access memory, read only memory, or any other medium which can be used to store information and be accessed by an instruction execution system, for example. An input/output (I/O) system provides communication between the control system 11 and peripheral devices.

FIG. 2 depicts another embodiment of an electric marine propulsion system 2. In the depicted embodiment, the electric marine propulsion system 2 includes an outboard marine drive 3 having an electric motor 4 housed therein, such as housed within the cowl 50 of the outboard marine drive. A person of ordinary skill in the art will understand in view of the present disclosure that the marine propulsion system 2 may include other types of electric marine drives, such as inboard drives or stern drives. The electric marine drive 3 is powered by the scalable storage device 16 including a bank of batteries 18.

The central controller 12, which in the depicted embodiment is a propulsion control module (PCM), communicates with the motor controller 14 via communication link 34, such as a CAN bus. The controller also receives input from and/or communicates with one or more user interface devices in the user interface system 35 via the communication link, which in some embodiments may be the same communication link as utilized for communication between the controllers 12, 14, 20 or may be a separate communication link. The user interface devices in the exemplary embodiment include a throttle lever 38 and a display 40. In various embodiments, the display 40 may be, for example, part of an onboard management system, such as the VesselView™ by Mercury Marine of Fond du Lac, Wisconsin. The user interface system 35 may also include a steering wheel 36, which in some embodiments may also communicate with the controller 12 in order to effectuate steering control over the marine drive 3, which is well-known and typically referred to as steer-by-wire arrangements. In the depicted embodiment, the steering wheel 36 is a manual steer arrangement where the steering wheel 36 is connected to a steering actuator that steers the marine drive 3 by a steering cable 37.

Figure 3:
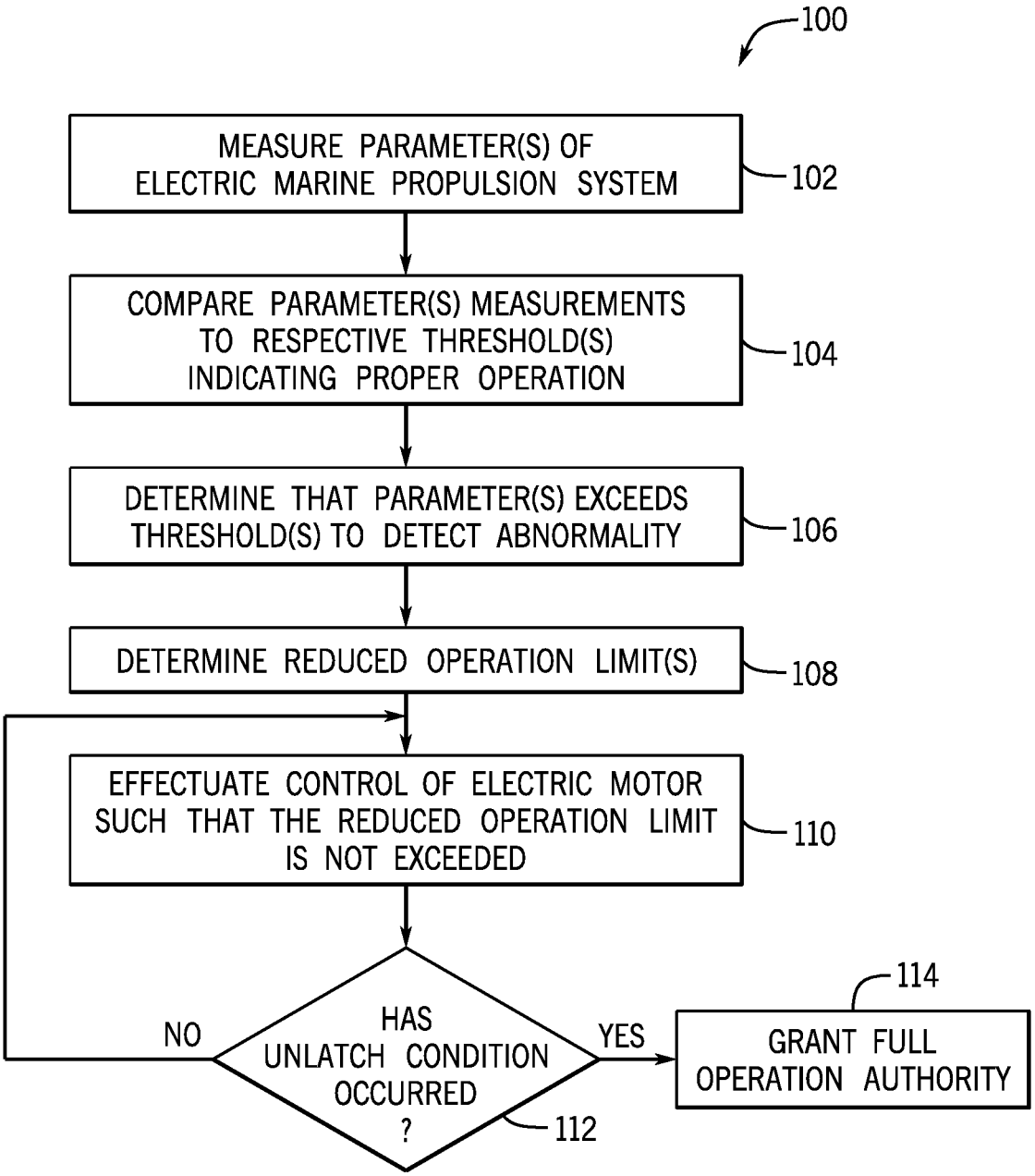
FIG. 3 is a flowchart depicting an exemplary embodiment of a method of controlling an electric marine propulsion system.

FIG. 3 depicts one embodiment of a method 100 of controlling an electric marine propulsion system 2 to effectuate reduced operation and prevent catastrophic failure in the event of an abnormality detection within the system 2. One or more parameters of the electric propulsion system are measured at step 102. As described herein, one or more of the plurality of parameters of the electric propulsion system may be measured, such as motor temperature, battery temperature, current supplied to the electric motor, voltage supplied to the electric motor, rotational speed of the electric motor, torque of the electric motor, and a rotational speed of the propeller. Each of the one or more parameters being measured is compared to a respective threshold range indicating proper operation at step 104.

The thresholds for each parameter are calibrated to account for various normal operating conditions. Thus, when one or more parameter measurements exceeds a respective threshold, then an abnormality is indicated as to the function of the electric marine propulsion system 2. The thresholds are, however, sufficiently less than or before a failure threshold where operation of one or more elements in the propulsion system 2 ceases. For example, the threshold ranges implemented in the disclosed control system may be significantly less than or occur before any error threshold at which the electric motor 4 would shut down and or before the power storage system would be disconnected so as to cease supplying power to the electric motor 4. Accordingly, the thresholds may be calibrated for early detection of a problem or abnormality before damage to the motor 4 or other system occurs and where intervention and reduced operation, such as reduced current and/or speed, can prevent further damage to the system 2 or at least delay catastrophic failure.

Once a parameter is outside of a relevant threshold range set for that parameter, an abnormality is detected at step 106. A reduced operation limit is then determined at step 108. The reduced operation limit may be determined based on the at least one parameter measurement that exceeded the respective threshold, and in some embodiments may be calculated based on two or more parameter measurements. The reduced operation limits may be calibrated to prevent further increase in the relevant parameters value(s), or otherwise to prevent the detected abnormality from increasing beyond the relevant threshold. For example, the reduced operation limit may be calibrated or otherwise determined to prevent an increase in the difference between the parameter measurement and the relevant threshold.

In certain embodiments, the reduced operation limit decreases as a difference between the parameter measurement and the threshold increases. Thus, the limit imposed by the reduced operation limit becomes more restrictive and further reduces operation of the electric propulsion system as the parameter measurement moves further outside the bounds of normal operation. For example, where the reduced operation limit is one of a torque limit, an RM limit, a current limit, or a power limit, the limit value decreases as the parameter measurement gets further outside of the normal range. In one embodiment, the reduced operation limit is determined by accessing a look-up table providing reduced operation limits corresponding to various possible values for a given parameter. Exemplary look-up tables are provided herein, which in various embodiments may provide reduced operation limits or limits, based on one or a plurality of parameter measurements.

Since the reduced operation limits are determined based on the parameter measurements rather than being single fixed values, the limits can be calibrated to allow a maximum amount of propulsion authority and ability to an operator while still preventing catastrophic failure. Thus, for only minor abnormalities that can be easily addressed with only a minor reduction in motor output, such as by allowing 90% of the normal maximum torque or RPM that the motor would ordinarily be capable of, the operator may experience only a minor difference in operation and may be permitted to get the vessel on plane or otherwise operate the vessel normally except avoiding the highest speed operation. However, in other examples the parameter measurement abnormality may require more drastic limits, such as where a current limit within the motor is significantly and/or continually exceeded. In such embodiments, only very low speed and/or low torque operation may be permitted with the lowest output limits that can facilitate movement of the marine vessel toward safety. In such embodiments, the reduced operation limit may be calibrated to minimize further damaging the motor as much as possible in order to delay catastrophic failure of the motor or other element in the propulsion system 2 as long as possible.

The electric motor 4 and/or power distribution thereto is then controlled at step 110 such that the reduced operation limit is not exceeded. For example, operator authority over propulsion may be granted up to the relevant limit set by the reduced operation limit. As described above, this may prevent the operator to operate the marine vessel normally at certain speeds below the maximum and, in some embodiments, may even permit the operator to get the vessel on plane and thus get home more quickly.

Once implemented, the reduced operation limit may be maintained until an unlatch condition has occurred. For example, the unlatch condition may be different depending on the exceeding parameter or detected abnormality. In various examples, the unlatch condition may be moving a throttle lever or other operator input device to a neutral, or zero speed, position. In other embodiments, the unlatch condition may be power cycling the propulsion system, such as turning the propulsion system off and then back on. In other embodiments, the unlatch condition may be based on the parameter measurement, such as maintenance of a parameter measurement below the threshold or below a different unlatch threshold that is lower than the normal threshold, for a period of time. Once the unlatch condition is detected at step 112, then full operation authority may be granted back to the user at step 114.

In certain embodiments, the system may include an accelerometer 32 to sense vibration, such as vibration caused by the motor 4. Excess vibration may be an indicator of a mechanical malfunction within the motor, such as a failed bearing or a jammed propeller. The accelerometer 32 is configured, for example, to measure a frequency and magnitude of vibration, such as in hertz and meters per second squared ($m/s^2$). In various embodiments, the frequency and/or the magnitude of vibration may be utilized and compared to one or more thresholds to identify an abnormality triggering a reduced operation limit. In embodiments where excess vibration occurs, the reduced operation limit may take the form of an RPM limit to limit the rotational speed of the electric motor.

Figure 4A:
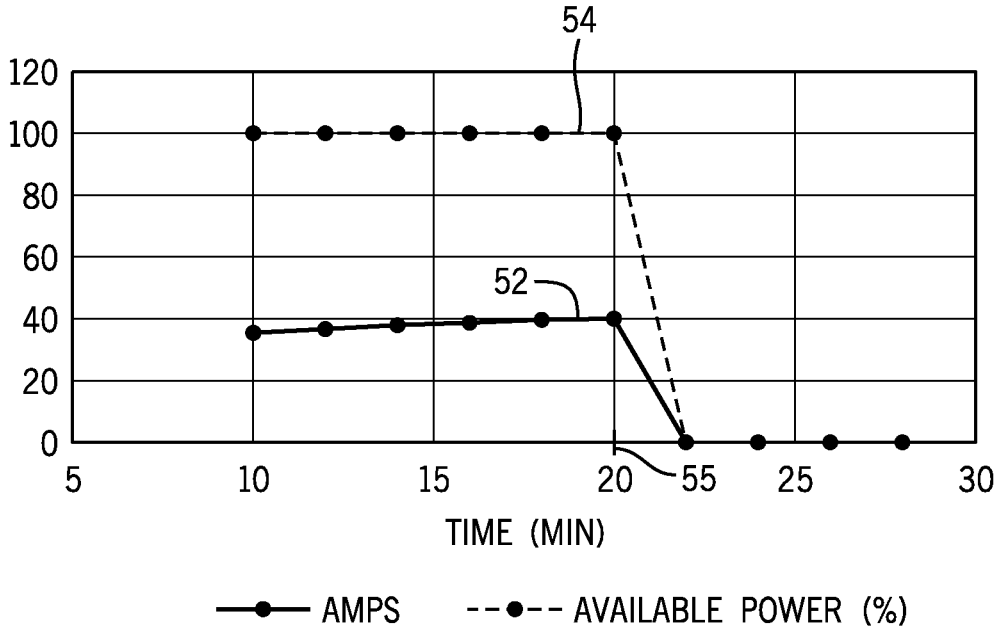
FIGS. 4A and 4B are graphs showing current and available power percentage consumed by an electric motor in two different control scenarios, where
Figure 4B:
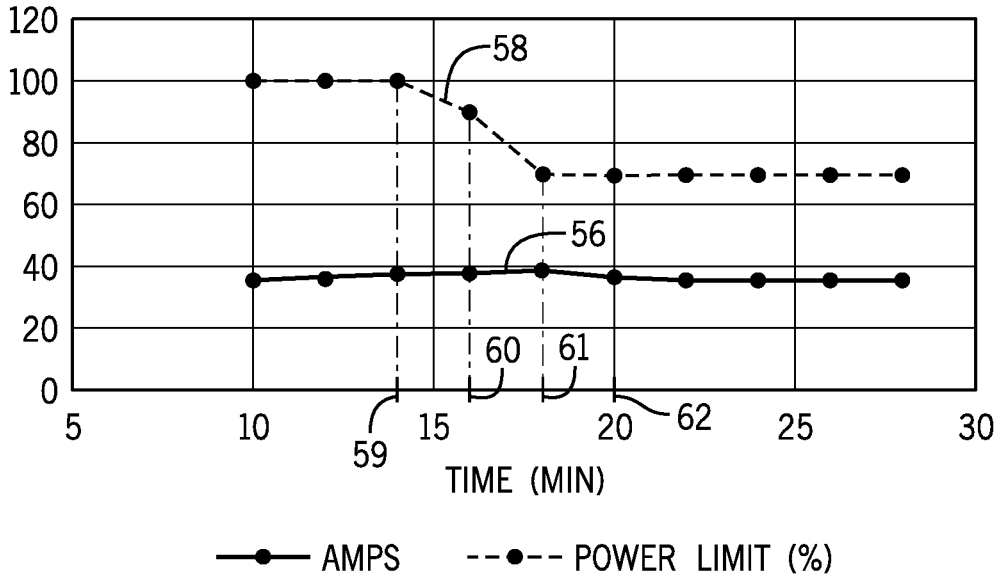

FIGS. 4A and 4B depict current over time delivered to an electric motor. A corresponding power limit is also shown in both scenarios at FIGS. 4A and 4B. FIG. 4A depicts an exemplary current and power limit relationship in a motor over current scenario where no reduced operation limit is imposed and the current increases over time and exceeds a threshold that trips a fault condition that ceases operation of the motor, such as by tripping a breaker that eliminates all power to the motor. Line 52 illustrates the current over time which increases to 40 amps at time point 55. In the depicted example, the current rating for the motor is set at 40 amps. The current increases beyond the failure setpoint and pops a breaker at time 55, causing the available power to go to zero. Line 54 represents the available power limit or power authority granted to an operator. 100% authority is granted to the operator to demand full output and function from the motor until the current limit is exceeded at time 55 triggering the fault, at which point the available power goes to zero and the motor no longer operates at all.

FIG. 4B depicts current and power limit as a function of time where an embodiment of the disclosed control method is utilized such that a reduced operation limit is imposed prior to triggering the fault condition, or failure point, by exceeding the 40 amp breaker limit. In the example at FIG. 4B, the current increases over time as represented by line 58 triggering sequential reductions in the reduced operation limit, which is exemplified here as a power limit, in reaction to the increasing current. Line 56 represents the current input to the motor 4 over time. At time 59 a first threshold is exceeded, where the current threshold is less than the 40 amp failure point. For example, the first threshold may be 37 amps, where the maximum available power to the motor is limited once the current reaches 37 amps. A reduced operation limit of 90% maximum available power is implemented the current reaches the 37 amp threshold at time 59.

Despite the reduced operation limit of 90% available power, the current continues to rise and at point 60 a second threshold of 38 amps is reached. Once the second threshold is reached, a further reduced operation limit of 70% maximum available power is implemented. Thus, operator authority over the amount of power utilized by the motor 4, and thus the output of the motor, is limited to 70% of the normal maximum power available. This reduces the current available to the motor. This 70% power limit is sufficient to keep the input current below the 40 amp shutdown threshold, and thus continued operation of the motor 4 and continued propulsion of the marine vessel is enabled, albeit at a reduced output. Thus, despite the abnormal operation, limiting the power results in facilitating a sustainable continued operation and reduces the amount of damage done by the overcurrent condition. The power limit of 70% available power is implemented at time 61 once the input power to the motor 4 reaches a 39 amp maximum.

The current drops below the 39 amp threshold at time 62. However, the 70% reduced operation limit is maintained since that is the reduced operation limit that enables the reduction in current. In certain embodiments, the system 2 may be configured such that once the reduced operation limit is implemented, full propulsion authority is not returned to the operator unless an unlatch condition occurs. Exemplary unlatch conditions are described above with respect to FIG. 3. Thus, as operation limits may be further reduced over time, the operation limits will not increase to grant authority back to the operator unless the unlatch condition has occurred.

FIGS. 5A-5F depict exemplary lookup tables providing reduced operation limits corresponding to various parameter values within a range of potential values for each respective parameter being monitored. While certain examples are provided in the Figures, a person of ordinary skill in the art will understand in view of the present disclosure that other parameters may be monitored and reduced operation limits imposed based on the monitored parameter in accordance with present disclosure.

FIG. 5A illustrates an exemplary table providing reduced operation limits indexed based on motor temperature in degrees Celsius (° C.). The reduced operation limits are implemented where either the motor is too cold or the motor is too hot. The reduced operation limit on a low temperature motor prevents damage to the motor being operated when it is too cold, and thus not well lubricated. The reduced operation limit on a high temperature motor prevents or limits overheating. Thus, with respect to motor temperature, in this example, a power limit is implemented where the motor temperature is outside of (either below or above) the normal temperature range for an operating motor. In the depicted example, the normal operating temperature range where full authority is granted for an operator to operate the motor to its maximum is between 10° C. and 110° C. When the motor temperature is below 10° C., a reduced operation limit is implemented.

In certain examples, interpolation may be used based on the motor temperature (or any parameter in the table) in order to calculate the reduced operation limit based on the table, which in the depicted example is a power limit as a percent of the maximum rated power for the motor 4. Thus, where the motor temperature is between 5° C. and 10° C., a power limit percent is calculated to be between 75% and 100%. Similarly, where the motor temperature is between 0° C. and 5° C., the power limit percent is calculated to be between 50% and 75%, interpolating between the values. Similar steps are provided when the motor temperature exceeds 110° C., where a reduced operation limit is again imposed to prevent damage to the motor from overheating. Where the motor temperature exceeds 120° C., a second high temperature threshold is exceeded and further reduced operation limits are implemented. Once the motor temperature reaches 130° C., a reduced operation limit of 10% input power limit is effectuated which greatly reduces the output and function of the electric motor 4 but maintains at least some degree of functionality so as to continue low speed propulsion.

FIG. 5B exemplifies a lookup table providing reduced operation limits corresponding to input current to the motor. This table corresponds to the example provided at FIG. 4B, where a reduced operation limit is implemented to prevent the current from exceeding the 40 amp threshold that will trip the breaker. The reduced operation limit is implemented once the input current reached 37 amps. A maximum reduced operation limit of 10% is implemented once the current approaches 40 amps. Beyond 40 amps, the system will not further reduce operation to further the goal of maintaining at least minimal output to support continued low speed propulsion for as long as possible. Thus, above the 40 amp failure threshold, the reduced operation limit remains at 10%. Thus, the disclosed method will not cease propulsion output, but only limits the operation as necessary to extend at least low speed propulsion for as long as possible.

FIG. 5C exemplifies a lookup table providing reduced operation limits corresponding to battery temperature in degrees Celsius. As described above, in certain embodiments the power storage device 16 may have an associated temperature sensor 21 to measure a temperature associated with the one or more batteries or other storage elements within the power storage device 16. If the battery temperature, such as measured by any temperature sensor 21 associated with any battery, exceeds a temperature threshold indicating high battery temperature, then a reduced operation limit is imposed.

The reduced operation limit becomes more restrictive as the battery temperature increases. Thus, as with all the examples provided herein, as the parameter measurement increasingly deviates from the threshold or the normal operation range, the reduced operation limit becomes more restrictive. Thus, where a difference between the parameter measurement and the threshold range increases, the reduced operation limit decreases. In an example where high and low thresholds are defined for the normal operation range, the difference may be a magnitude difference between the parameter value and the closest one of the high or low threshold defining the threshold range. Thus, referring to the battery temperature example at FIG. 5C, as the battery temperature parameter exceeds the 90° C. threshold, the reduced operation limit decreases. As the battery temperature exceeds 105° C., and thus is progressing very close to a problematic temperature threshold, the reduced operation limit is reduced at an increasing rate such that only 10% power limit authority is granted once the battery temperature reaches 110° C.

FIG. 5D depicts an exemplary table providing reduced operation limits corresponding to motor input voltage, where reduced operation limits are imposed where the input voltage to the motor is above or below the normal voltage range, which in the depicted example is 46-52 volts. This would apply, for example, to a 48 volt system such as that depicted in FIG. 2. Where the motor input voltage is below that normal range, and thus below the threshold of 46 volts, then an undervoltage scenario has occurred and an output limit restriction is imposed that increasingly restricts the power limit for the motor as the undervoltage condition becomes more severe. In this example, a maximum power limit of 10% of the total normal power limit may be implemented when the motor voltage reaches a low of 31 volts or a high of 56 volts. A power limit between 10% and 100% is calculated in an undervoltage or overvoltage scenario where the motor input voltage is outside of the normal range of 46 to 52 volts but within the range of 31 to 56 volts. Such a reduced operation limit is calculated based on the motor input voltage parameter measurement by interpolating the table values, as described above.

FIG. 5E depicts reduced power limits corresponding to various motor speed values so as to protect against both over and under speed. In the depicted example, normal motor speed range is defined as rotation speeds between 100 and 3000 revolutions per minute (rpm). Any rotational speed measured below or above that range is considered an indicator of abnormal operation and induces a reduced operation limit, which in this example again is a power limit that limits the available power to the operator to a defined percentage of the maximum rated available power for the motor 4 under normal operating conditions.

Though the examples here refer to a power limit, in other embodiments the reduced operation limit may be implemented by controlling one or more other parameters of the motor, such as by controlling torque output of the motor 4, by controlling rotational speed of the motor, or by specifically limiting current rather than available power.

FIG. 5F depicts an example where rotational speed of the motor is limited based on sensed vibration of the motor 4. For example, vibration magnitude measured by the accelerometer 32 may be monitored to detect that the vibration is within an expected range. High vibration may indicate a mechanical abnormality within the motor 4 or the propeller 10. Vibration magnitude may be measured, for example, as a g-force. Where the acceleration exceeds a normal threshold, which is exemplified here as 0.35 g, then a reduced operation limit is implemented to reduce the rotational speed of the motor 4. As the vibration magnitude increases beyond that threshold, the reduced operation limit increases at an increasing rate so as to prevent catastrophic failure caused by the mechanical issue. As the vibration increases beyond 0.70 g (twice the initial threshold), the operation limit becomes significantly more restrictive. At and above 1.05 g, the operation limit is a 10% RPM limit (meaning that the maximum permitted RPM of the motor is 10% of the normal maximum RPM limit permitted under normal operating conditions). By reducing the rpm, mechanical strain placed on the marine drive 3 is reduced so as to prevent damage and/or prolong operation of the drive as long as possible.

The reduced operation limit determination may occur, for example, at the central controller 12 and be communicated to the motor controller 14 for implementation. For example, the reduced operation limit may be communicated from the central controller 12 to the motor controller 14 via CAN bus or by some other communication link. In such an embodiment, the central controller 12 may store one or more lookup tables, such as those exemplified herein, providing reduced operation limits based on parameter values and enabling calculation of a reduced operation limit based on a specific measure parameter as described in the examples illustrated at FIGS. 5A-5F. In certain embodiments, reduced operation limits can be calculated on two or more parameter measurements. For example, lookup tables providing reduced operation limits indexed based on two parameter values may be provided and two-dimensional table. Thus, the interplay between two parameters can be fully accounted for in the reduced operation limit calculation. Similarly, a three-dimensional table may provide reduced operation limits indexed based on three parameters.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A method of controlling an electric marine propulsion system configured to propel a marine vessel, the method comprising:

measuring at least one parameter of the electric marine propulsion system;

determining that the parameter measurement indicates an abnormality in the electric marine propulsion system;

determining a reduced operation limit based on the at least one parameter measurement, wherein the reduced operation limit includes at least one of a torque limit, an rpm limit, a current limit, and a power limit; and controlling an electric motor in the electric marine propulsion system such that the reduced operation limit is not exceeded.

2. The method of claim 1, wherein the reduced operation limit decreases as a difference increases between the at least one parameter measurement and a threshold.

3. The method of claim 2, wherein the reduced operation limit is calibrated to prevent an increase in the difference.

4. The method of claim 1, wherein determining that the parameter measurement indicates an abnormality in the electric marine propulsion system includes determining that the parameter measurement is outside of a threshold range.

5. The method of claim 4, wherein the threshold range and the reduced operation limit are calibrated to prevent short term catastrophic failure of the electric motor and enable an operator to continue at least low speed propulsion of the marine vessel.

6. The method of claim 1, wherein determining the reduced operation limit includes accessing a lookup table providing reduced operation limits corresponding to various parameter values.

7. The method of claim 6, wherein the at least one parameter includes a motor temperature and wherein the lookup table provides the reduced operation limits corresponding to various motor temperatures.

8. The method of claim 6, wherein the at least one parameter includes an input current supplied to the electric motor and wherein the lookup table provides the reduced operation limits corresponding to various current amounts.

9. The method of claim 6, wherein the at least one parameter includes an input voltage to the electric motor and wherein the lookup table provides the reduced operation limits corresponding to various voltages.

10. The method of claim 6, wherein the at least one parameter includes a battery temperature of a power storage device powering the electric motor, and wherein the lookup table provides the reduced operation limits corresponding to various battery temperatures.

11. The method of claim 6, wherein the at least one parameter includes a motor speed of the electric motor, and wherein the lookup table provides the reduced operation limits corresponding to various rotational speeds.

12. The method of claim 6, wherein the at least one parameter includes a vibration of the electric motor, and wherein the lookup table provides the reduced operation limits corresponding to various vibration magnitudes.

13. The method of claim 1, further comprising measuring at least two parameters of an electric motor in the electric marine propulsion system and determining the reduced operation limit based on both of the at least two parameter measurements.

14. The method of claim 13, wherein determining the reduced operation limit includes accessing a lookup table providing reduced operation limits indexed based on various parameter values for each of the at least two parameters.

15. An electric marine propulsion system comprising:

an electric motor driving a propeller into rotation and configured to propel a marine vessel;

a power storage device configured to power the electric motor;

at least one sensor configured to measure at least one parameter of the electric marine propulsion system, including at least one of a motor temperature sensor configured to sense a temperature of the electric motor, a battery temperature sensor configured to sense a temperature within the power storage device, a current sensor configured to sense an input current supplied to the electric motor, a voltage sensor configured to sense an input voltage supplied to the electric motor, a motor speed sensor configured to sense a rotational speed of the electric motor, and a propeller speed sensor configured to sense a rotational speed of the propeller; and a control system configured to:

determine that the at least one parameter of the electric marine propulsion system is outside a threshold range indicating an abnormality;

determine a reduced operation limit based on the at least one parameter, wherein the reduced operation limit includes at least one of a torque limit, an rpm limit, a current limit, and a power limit; and control the electric motor such that the reduced operation limit is not exceeded.

16. The system of claim 15, wherein the reduced operation limit decreases as a difference increases between the at least one parameter and the threshold range.

17. The system of claim 16, wherein the reduced operation limit is calibrated to prevent an increase in the difference.

18. The system of claim 15, wherein the electric motor comprises a rotor and a stator, the stator having a stator winding, and further comprising a motor controller is configured to control power to the stator winding;

wherein the control system is configured to determine a power limit for the stator winding based on the at least one parameter and, through the motor controller, control power to the stator winding such that the reduced operation limit is not exceeded.

19. The system of claim 15, wherein the controller is further configured to store a lookup table providing reduced operation limits corresponding to various parameter values, and to utilize the lookup table for determining the reduced operation limit based on the at least one parameter.

20. The system of claim 15, wherein the controller is further configured to determine that at least two parameters of the electric marine propulsion system indicate an abnormality and determining the reduced operation limit based on both of the at least two parameters.

21. The system of claim 20, wherein the controller is further configured to store a lookup table providing reduced operation limits indexed based on various parameter values for each of the at least two parameters, and to utilize the lookup table for determining the reduced operation limit based on the at least two parameters.

22. The method of claim 1, wherein the reduced operation limit is less than a maximum operation limit and enables at least low speed propulsion of the marine vessel.

* * * * *